US006062990A

United States Patent [19]

Pierce

[11] Patent Number: 6,062,990

[45] Date of Patent: May 16, 2000

[54] GOLF TEE

[76] Inventor: Clifford G. Pierce, 1222 Prospect Dr., Mishawaka, Ind. 46544

[21] Appl. No.: 09/098,138

[22] Filed: Jun. 16, 1998

[51] Int. Cl.[7] ..... A63B 57/00

[52] U.S. Cl. ..... 473/387; 473/402

[58] Field of Search ..... 473/387–403

[56] References Cited

U.S. PATENT DOCUMENTS

| | | | |
|---|---|---|---|
| D. 210,837 | 4/1968 | Warner | 473/402 |
| 1,623,782 | 4/1927 | Dent et al. | 473/392 |
| 1,641,155 | 9/1927 | Clausing | 473/402 |
| 1,781,684 | 11/1930 | Dunkelsberg . | |
| 1,860,307 | 5/1932 | Brinck . | |
| 2,018,146 | 10/1935 | Penny | 473/402 |
| 2,082,811 | 6/1937 | Thorup | 473/402 |
| 2,455,705 | 12/1948 | Seager | 473/402 |
| 4,192,504 | 3/1980 | Clugage | 473/403 |
| 4,783,077 | 11/1988 | Lemon | 473/402 |
| 4,951,945 | 8/1990 | Gamble | 473/400 |
| 5,413,330 | 5/1995 | Disco et al. | 473/387 |

*Primary Examiner*—Steven Wong
*Attorney, Agent, or Firm*—Hill & Simpson

[57] ABSTRACT

A golf tee is shown and described which provides a variety of benefits. The ball rest is disposed in a forward direction to provide more time and space for the club head to travel prior to impact with the ball. The ball rest also includes channels for dispelling or exhausting air generated by the moving club head for improved ball/club head contact. The stem is curved arcuately for facilitating the insertion of the tee in the ground as well as insuring that the tee exits the ground in a reliably forward direction to facilitate the finding of the tee after the ball is struck. The tee stem also can provide a finger rest to facilitate insertion of the tee into the ground and an optical alignment aid to assist the golfer in lining up the shot. The stem of the tee may also be equipped with barbs or hooks to secure the position of the tee in the ground. The curved stem also enables the tee to be used as a ball mark repair tool.

14 Claims, 4 Drawing Sheets

GOLF TEE

FIELD OF THE INVENTION

The present invention relates generally to golf tees. More specifically, the present invention relates to a golf tee which, in addition to supporting a golf ball above ground, provides one or more of the following benefits: promotes better contact between the golf club and the golf ball; facilitates the insertion of the golf tee into the ground; provides an optical aid to the golfer to assist in alignment of the shot; assures that the golf tee exits the ground in a forward direction; provides a better grip between the tee and the ground; and/or also provides a golf tee that can be used as a ball mark repair tool.

BACKGROUND OF THE INVENTION

Golf tees are known in the art. The typical tee includes a generally horizontal concave ball rest that is connected to an axially aligned shaft or stem that extends downward from the ball rest. Most tees are made from wood; tees that are intended to be used repeatedly can be made from more durable materials, such as plastic.

In addition to the conventional tee described above, U.S. Pat. No. 2,082,811 discloses a tee with a curved blade-like stem or shaft. However, due to the curved nature of the stem, the tee disclosed in the '811 patent is inherently difficult to insert into the ground which makes it difficult to tee up the ball. U.S. Pat. No. 1,781,684 discloses a golf tee whereby the ball rest is disposed at a 90° angle with respect to the stem. The design of the tee disclosed in the '684 patent would require the tee to be fabricated from an inherently strong material such as metal so that the tee could withstand the downward pressure imposed on the ball rest as the ball and tee are pushed downward into the ground. Further, contact between the golf club head and the ball rest of the '684 patent can slow the speed of the club head as it strikes the ball thereby hindering good ball contact. U.S. Pat. No. 1,860,307 discloses a metal golf tee whereby the position of the ball rest with respect to the stem can be adjusted due to the thin metal connection between the ball rest and the stem. Like the '811 and '684 patents, insertion of this tee into the ground would prove difficult, particularly in conditions where the ground is hard or partially frozen. Further, the construction of the clover-leaf ball rest of the '307 patent and the club head would hinder good ball contact. Thus, the conventional tee described above along with the tees disclosed in the '811, '307 and '684 patents all suffer from some common deficiencies. First, they are difficult to insert into the ground. Second, they provide the golfer with no visual alignment assistance. Being properly aligned is a key concept in golf.

Third, depending upon the conditions, a golfer may desire the tee to remain in the ground or be propelled out of the ground upon impact in a reliable direction. None of the tees disclosed in the prior art are intended to be propelled in a single direction. Thus, when the tees are propelled out of the ground upon contact, they are often lost and must be replaced. Fourth, and perhaps more important, none of the above-described tees promote or insist in promoting good contact between the club face and the ball. In fact, interference between the ball rest of the above-described tees and the club head actually hinders good ball contact, club head speed and therefore hinders ball flight. Fifth, none of the tees described above are suitable for use as a ball mark repair tool due to the slender shaft or stem and lack of any hand or finger grip.

Finally, the inventor has found that, as the club head approaches the ball just prior to impact, a flow of air engages the ball and can move the ball in a forward direction or bias the ball in a forward direction because none of the ball rests of the tees known in the art provide a way to effectively channel such air flow around the ball. As a result, the impact between the club head and the ball can be compromised because of this slight forward movement or forward biasing of the ball.

Accordingly, there is a need for an improved golf tee which promotes good ball contact, is easy to insert into the ground, provides an optical alignment aid for the golfer, and is either propelled out of the ground in a reliable direction or maintains its position in the ground.

SUMMARY OF THE INVENTION

The present invention satisfies the aforenoted needs by providing an improved golf tee which comprises a stem having a lower end for insertion into the ground and an upper end that is connected to a ball rest for supporting the golf ball. The stem is curved in an arcuately rearward direction with respect to the golfer's sight line (i.e. the stem curves away from the direction of the intended ball flight). The stem further comprises a rear edge and a forward edge. The forward edge of the stem comprises an arcuate cut-out portion which comprises a non-vertical surface for providing a finger-grip to assist the golfer in inserting the stem of the tee into the ground.

In an embodiment, the forward edge further comprises a curved surface for facilitating forward movement of the tee out of the ground upon a forward impact between the club head and the upper end of the stem.

In an embodiment, the arcuate cut-out portion of the rear edge of the stem comprises a non-vertical surface that extends forwardly in alignment with the golfer's sight line for providing an optical alignment aid.

In an embodiment, the rear edge of the stem further comprises an arcuate surface that extends longitudinally from the lower end of the stem towards the upper end of the stem.

In an embodiment, a portion of the rear edge of the stem is disposed laterally rearward of the ball rest when the tee is disposed in a vertical position.

In an embodiment, the forward edge of the stem further comprises at least one barb for securing the tee in place after the stem is inserted into the ground.

In an embodiment, the lower end of the stem further comprises at least one barb for securing the tee in place after the stem is inserted into the ground.

In an embodiment, the lower end of the stem further comprises at least one hook for securing the tee in place after the stem is inserted into the ground.

In an embodiment, the ball rest further comprises a rear edge, a front edge and a channel extending from the rear edge to the front edge. The channel permits air to flow underneath the ball just prior to impact between the ball and the club head thereby promoting good contact between the club head and the ball.

In an embodiment, the ball rest further comprises a plurality of upward extending pedestals for supporting the ball.

In an embodiment, the ball rest comprises a concave surface for engaging the ball and an outer periphery of the ball rest further comprises at least one outer flange to facilitate the placement and support of the ball on the ball rest.

In an embodiment, the ball rest further comprises front and rear edges and opposing side edges, all of which include flanges for facilitating the placement and support of the ball on the ball rest.

It is therefore an advantage of the present invention to provide a golf tee with a rearwardly disposed ball rest to provide more time and space for the club head to travel prior to impact with the stem of the tee thereby promoting good contact between the club head and the ball.

Another advantage of the present invention is that it provides an improved golf tee with a ball rest positioned and configured to promote good contact between the club head and the golf ball.

Another advantage of the present invention is that it provides a ball rest that permits air flow generated by movement of the club head to be released underneath the ball prior to impact thereby promoting good contact between the club head and the golf ball.

Another advantage of the present invention is that it provides a golf tee that serves as an optical alignment aid for the golfer.

Another advantage of the present invention is that it provides a golf tee that exits the ground upon forward impact between the club head and the upper end of the stem or the ball rest in a reliably forward direction thereby enabling the golfer to more easily find the tee after striking the ball.

Another advantage of the present invention is that it provides a golf tee with a finger grip or finger rest to facilitate the insertion of the tee into the ground.

Yet another advantage of the present invention is that it provides a golf tee that can also be used as a ball mark repair tool.

Still another advantage of the present invention is that it provides a golf tee having a ball rest that channels air underneath the ball prior to impact thereby promoting good contact between the club head and the golf ball.

Other objects and advantages of the present invention will become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of an examples of the present invention.

In the drawings.

Figure 1:
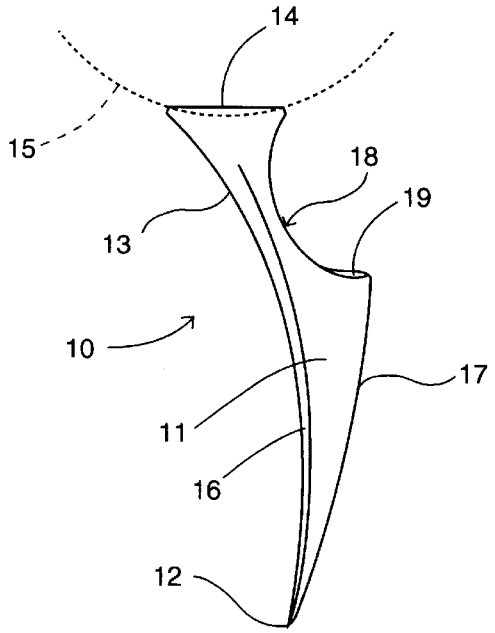
FIG. 1 is a side view of a first embodiment of a golf tee made in accordance with the present invention.
Figure 2:
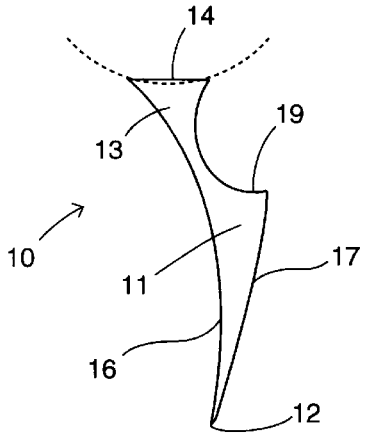
FIG. 2 is another side view of the golf tee shown in FIG. 1.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS INCLUDING THE PREFERRED EMBODIMENTS

Turning first to FIGS. 1–5, a golf tee 10 is illustrated which includes a stem 11 having a lower end 12 and an upper end 13. The upper end 13 is connected to a ball rest shown at 14 for supporting a golf ball 15, shown in phantom. The stem 11 includes a rear edge 16 and a front edge 17. The general configuration of the stem 11 is an arcuate curvature in a rearward direction, or opposite to the intended flight line of the golf ball. The curved front edge 17 of the stem 11 includes an arcuate cut-out 18 which serves at least two functions. First, a lower portion 19 of the cut-out 18 can serve as a finger rest or finger grip for assisting the golfer in inserting the tee into the ground. Second, referring to FIG. 5, the lower portion of the arcuate cut-out 18 can also serve as an optical alignment aid. Specifically, the golfer can insert the tee 10 into the ground so that the surface 19 and the ball rest 14 are aligned generally along the intended flight line of the golf ball. Such an alignment aid can be particularly important when there are no tee markers or when the tee markers are arranged at a deceptive angle with respect to the preferred flight line of the golf ball. Further, the optical aid provided by the surface 19 assists the golfer in concentrating on the mechanics of the upcoming shot because the golfer is assured that he/she is properly aligned.

Figure 3:
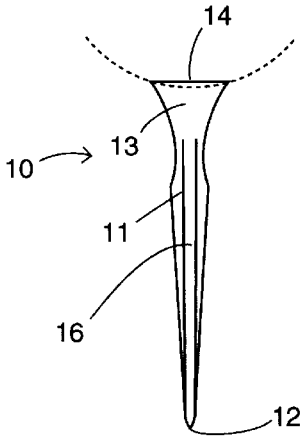
FIG. 3 is a rear view of the golf tee shown in FIG. 1.
Figure 4:
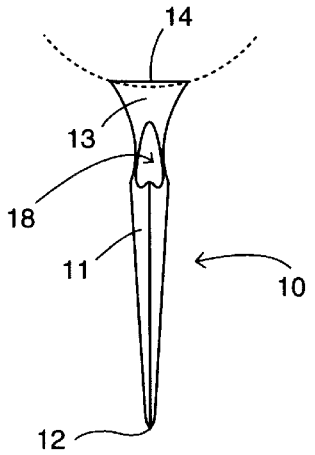
FIG. 4 is a front view of the golf tee shown in FIG. 1.
Figure 5:
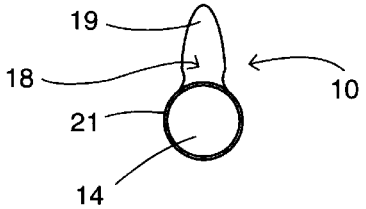
FIG. 5 is a top plan view of the golf tee shown in FIG. 1.

The curvatures of the front edge 16 and rear edge 17 also facilitate the exit of the tee 10 from the ground in a generally forward direction after impact between the upper end 13 of the stem 11 and the club head (not shown) or between the ball rest 14 and the club head. In other words, in those instances where the golfer makes contact between the club head and the tee 10, the tee 10 will be reliably propelled forward thereby making it easier to find the tee 10 after the shot. As shown in FIG. 3, the front edge 16 can be tapered to facilitate the insertion of the tee 10 in the ground (not shown). As shown in FIG. 5, the ball rest 14 includes an outer periphery 21 for facilitating the placement of the ball 15 on the ball rest 14.

Figure 6:
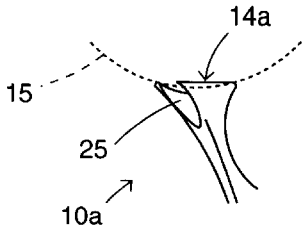
FIG. 6 is a partial side view of a second embodiment of a golf tee made in accordance with the present invention.
Figure 7:
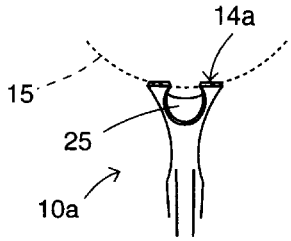
FIG. 7 is a partial rear view of the golf tee shown in FIG. 6.
Figure 8:
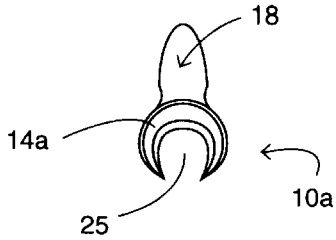
FIG. 8 is a top plan view of the golf tee shown in FIG. 6.

Turning to the embodiment shown in FIGS. 6–8, the ball rest 14*a* of the tee 10*a*can further include a channel 25 that extends through the ball rest 14*a*. The channel 25 allows forwardly moving air generated by the club head to pass underneath the ball 15 prior to impact. The release of this forwardly moving air promotes good ball/club head contact and reduces premature forward movement of the ball 15 prior to impact between the ball 15 and the club head. The ball rest 14*a* still provides sufficient surface area to adequately support the ball 15.

Figure 9:
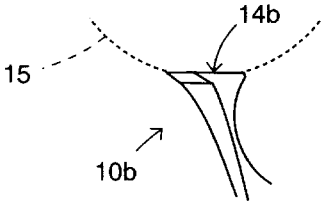
FIG. 9 is a partial side view of a third embodiment of a golf tee made in accordance with the present invention.
Figure 10:
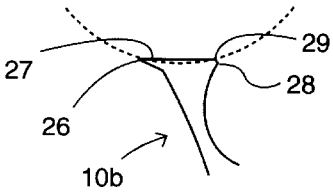
FIG. 10 is another partial side view of the golf tee shown in FIG. 9.
Figure 11:
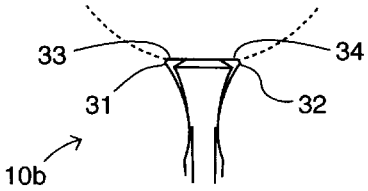
FIG. 11 is a rear view of the golf tee shown in FIG. 9.

Turning to the embodiment shown in FIGS. 9–11, a tee 10*b* is shown with a ball rest 14*b* that includes a forward edge 28 with a forward flang 29 as well as a rear edge 26 and a rear flange 27 for providing additional support for the ball 15. As shown in FIG. 11, opposing side edges 31, 32 include opposing side flanges 33, 34 respectively for providing additional ball support as well.

Figure 12:
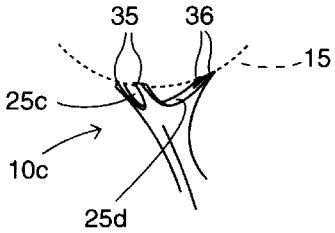
FIG. 12 is a partial side view of a fourth embodiment of a golf tee made in accordance with the present invention.
Figure 13:
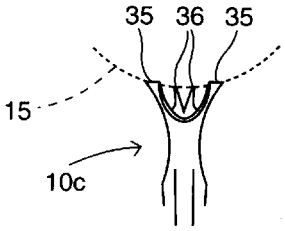
FIG. 13 is a partial rear view of the golf tee shown in FIG. 12.
Figure 14:
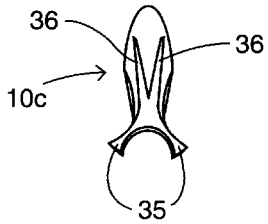
FIG. 14 is a top plan view of the golf tee shown in FIG. 12.

Turning to the embodiment shown in FIGS. 12–14, the tee 10*c* includes a channel 25*c* similar to the one discussed above with respect to FIGS. 6–8. However, while the channel 25*c* extends generally in alignment with the intended flight line of the golf ball 15, an additional perpendicular channel 25*d* provides additional space for air to be exhausted underneath the ball 15. The front and rear pedestals shown at 36, 35 respectively provide adequate support for the ball 15. The two pedestals 36 can also act as a guiding ramp for the ball.

Figure 15:
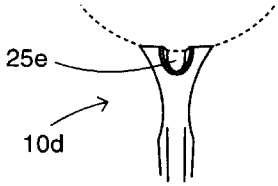
FIG. 15 is a partial rear view of a fifth embodiment of a golf tee made in accordance with the present invention.
Figure 16:
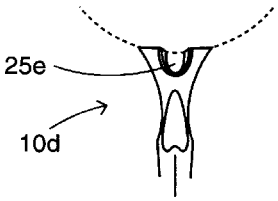
FIG. 16 is a front view of the golf tee shown in FIG. 15.
Figure 17:
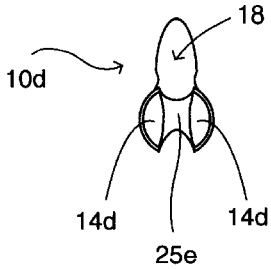
FIG. 17 is a top plan view of the golf tee shown in FIG. 15.

The tee 10*d* as shown in FIGS. 15–17 includes many of the same features of the tee 10*a* as shown in FIGS. 6–8. However, instead of a semi-circular ball rest 14*a,* the ball rest 14*d* is split into two half sections with a central channel 25*e* disposed therebetween. Again, the channel 25*e* permits air to be exhausted underneath the ball.

Figure 18:
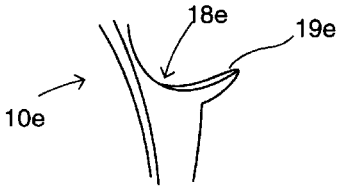
FIG. 18 is a partial side view of a sixth embodiment of a golf tee made in accordance with the present invention.
Figure 19:
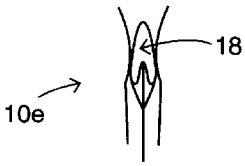
FIG. 19 is a partial front view of the golf tee shown in FIG. 18.
Figure 20:
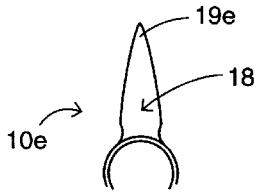
FIG. 20 is a partial top plan view of the golf tee shown in FIG. 18.

Turning to the tee 10*e* shown in FIGS. 18–20, the arcuate cut-out 18*e* includes a rearward extension 19*e* which provides a narrower and longer optical aid than the surface 19 as shown in FIGS. 1 and 5 with respect to the tee 10.

Figure 21:
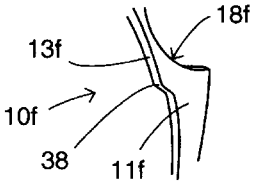
FIG. 21 is a partial side view of a seventh embodiment of a golf tee made in accordance with the present invention.
Figure 22:
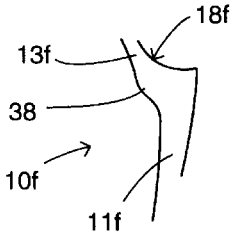
FIG. 22 is another partial side view of the golf tee shown in FIG. 21.
Figure 23:
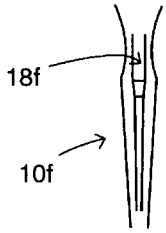
FIG. 23 is a partial front view of the golf tee shown in FIG. 21.

In the embodiment 10*f* as shown in FIGS. 21–23, a smaller arcuate cut-out 18*f* is utilized and the upper end 13*f* of the stem 11*f* is reinforced by way of the extension shown at 38.

Figure 24:
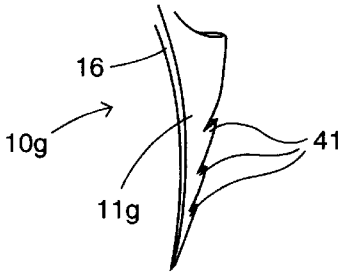
FIG. 24 is a partial side view of an eighth embodiment of a golf tee made in accordance with the present invention.
Figure 25:
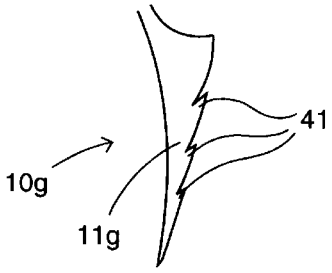
FIG. 25 is another partial side view of the golf tee shown in FIG. 24.
Figure 26:
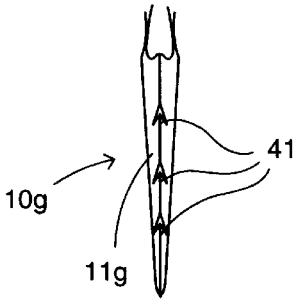
FIG. 26 is a partial front view of the golf tee shown in FIG. 24.
Figure 27:
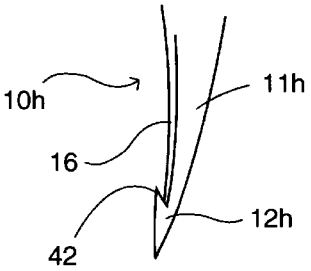
FIG. 27 is a partial side view of a ninth embodiment of a golf tee made in accordance with the present invention.
Figure 28:
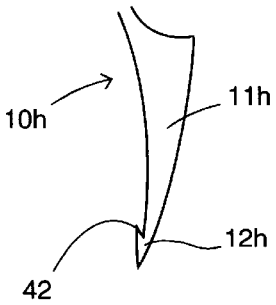
FIG. 28 is another partial side view of the golf tee shown in FIG. 27.
Figure 29:
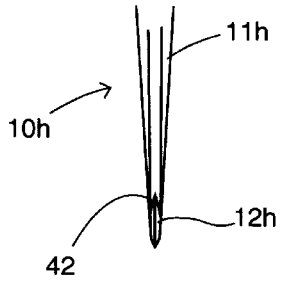
FIG. 29 is a partial rear view of the golf tee shown in FIG. 27.

In the embodiment 10*g* as shown in FIGS. 24–26, the stem 11*g* includes a plurality of barbs shown at 41 for securing the tee 10*g* in place in the ground (not shown) and providing added resistance to help keep the tee in the ground after impact. The surface of the rear edge 16 is preferably smooth or flat. Similarly, in the embodiment 10*h* shown in FIGS. 27–29, the lower end 12*h* of the stem 11*h* includes a hook or barb 42 that extends in a rearward direction for securing the tee 10*h* in the ground (not shown) after insertion and for helping to hold the tee 10*h* in the ground after impact. The barbs 41 and the hook 42 help reduce the flight of the tee 10*g,* 10*h* after impact thereby reducing the likelihood of the tee 10*g,* 10*h* becoming lost and/or help to keep the tee 10*g,* 10*h* in the ground after impact by adding resistance between the stem 11*g,* 11*h* and the ground.

As shown above, a tee made in accordance with the present invention facilitates the golfer's ability to insert the tee in the ground by way of a finger rest 19 (FIGS. 1–5), can provide an optical alignment aid in the form of a surface 19 (FIGS. 1–5) and 19*e* (FIGS. 18–20), air channels for discharging or exhausting air flow generated by the club head for improving ball contact such as the channel 25 (FIGS. 6–8), the channels 25*c,* 25*d* (FIGS. 12–14) and the channel 25*e* (FIGS. 15–17), improved grip between the tee stem and the ground by way of barbs 41 and 42 (FIGS. 24–29), a tee that exits the ground in a reliably forward direction as provided by the arcuate front and rear edges 16,17 (FIGS. 1–5), and the general placement of a ball in a forward direction thereby providing more time and space for the club head to travel prior to impact (FIGS. 1–5). Further, due to the curved nature of the stem as shown in FIGS. 1–5, the tee 10 can also be used as a ball mark repair tool.

From the above description, it is apparent that the advantages and objects of the present invention have been achieved. While only certain embodiments have been set forth, alternative embodiments and various modifications will be apparent from the above description to one skilled in the art. These and other alternatives are considered equivalents and within the spirit and scope of the present invention.

What is claimed:

1. A golf tee for supporting a golf ball above ground prior to impact with a golf club head, the tee comprising:

a stem having a lower end for insertion into the ground and an upper end connected to a ball rest for supporting the golf ball, the stem being curved in an arcuately rearward direction, the stem further comprising a forward edge and a rear edge, the forward edge comprising an arcuate cut-out portion which comprises a substantially horizontal surface for providing a finger-grip separate and apart from the ball rest to assist in inserting the stem of the tee into the ground, the ball rest further comprising a rear edge, a front edge and an unobstructed channel extending below the front and rear edges, through the ball rest and from the rear edge to the front edge, the channel permitting air to flow underneath the ball prior to impact between the ball and the club head.

2. The tee of claim 1 wherein the forward edge comprising a curved surface for facilitating forward movement of tee out of the ground upon a forward impact between the club head and the upper end of the stem or the ball rest.

3. The tee of claim 1 wherein the substantially horizontal surface extends forwardly for providing an optical alignment aid.

4. The tee of claim 1 wherein the rear edge of the stem further comprises an arcuate surface extending longitudinally from the lower end of the stem towards the upper end of the stem.

5. The tee of claim 4 wherein a portion of the rear edge of the stem is disposed laterally forward of the ball rest.

6. The tee of claim 1 wherein the forward edge of the stem further comprises at least one barb for securing the tee in place in the ground.

7. The tee of claim 1 wherein the lower end of the stem further comprises at least one barb for securing the tee in place in the ground.

8. The tee of claim 1 wherein the lower end of the stem further comprises a hook for securing the tee in place in the ground.

9. The tee of claim 1 wherein the ball above the channel rest further comprises a plurality of upwardly extending pedestals for supporting the ball.

10. A golf tee for supporting a golf ball above ground prior to impact with a golf club head, the tee comprising:

a stem having a lower end for insertion into the ground and an upper end connected to a ball rest for supporting the golf ball, the stem being curved in an arcuately rearward direction, the stem further comprising a forward edge and a rear edge, the forward edge comprising a curved surface for facilitating forward movement of tee out of the ground upon a forward impact between the club head and the upper end of the stem, the forward edge further comprising an arcuate cut-out portion which comprises a substantially planar surface separate and apart from the ball rest for providing a finger-grip to assist in inserting the stem of the tee into the ground, the substantially planar surface extending forwardly for providing an optical alignment aid, the ball rest further comprising a rear edge, a front edge and an unobstructed channel extending below the front and rear edges, through the ball rest and from the rear edge to the front edge, the channel permitting air to flow underneath the ball prior to impact between the ball and the club head.

11. The tee of claim 10 wherein the forward edge of the stem comprises at least one barb for securing the tee in place in the ground.

12. The tee of claim 10 wherein the lower end of the tee comprises at least one barb for securing the tee in place in the ground.

13. The tee of claim 10 wherein the lower end of the tee comprises at least one hook for securing the tee in place in the ground.

14. A combination golf tee for supporting a golf ball above ground prior to impact with a golf club head and ball mark repair tool, the combination tee/repair tool comprising:

a stem having a lower end for insertion into the ground and an upper end connected to a ball rest for supporting the golf ball, the stem being curved in an arcuately rearward direction, the stem further comprising a forward edge and a rear edge, the forward edge comprising a curved surface for facilitating forward movement of tee out of the ground upon a forward impact between the club head and the upper end of the stem, the forward edge further comprising an arcuate cut-out portion which comprises a substantially planar surface separate and apart from the ball rest for providing a finger-grip to assist in inserting the stem of the tee into the ground, the substantially planar non-vertical surface extending forwardly for providing an optical alignment aid, the forward edge of the stem further comprising at least one barb for securing the tee in place after it is inserted into the ground, the ball rest further comprising a rear edge, a front edge and a channel extending from the rear edge to the front edge, the channel permitting air to flow underneath the ball prior to impact between the ball and a club head.

* * * * *